US006637330B1

(12) United States Patent
Nordby et al.

(10) Patent No.: US 6,637,330 B1
(45) Date of Patent: Oct. 28, 2003

(54) DOCTOR BLADE SYSTEM

(75) Inventors: Klaus Nordby, Vejen (DK); Jan Kjaer Larsen, Sdr. Steuderup (DK); Erik Gydesen, Vejle (DK); Uffe Bastrup, Kolding (DK)

(73) Assignee: Tresu Production A/S, Bjert (DK)

( * ) Notice: Subject to any disclaimer, the term of this patent is extended or adjusted under 35 U.S.C. 154(b) by 0 days.

(21) Appl. No.: 10/018,528

(22) PCT Filed: Jun. 20, 2000

(86) PCT No.: PCT/DK00/00327

§ 371 (c)(1),
(2), (4) Date: Mar. 6, 2002

(87) PCT Pub. No.: WO00/78548

PCT Pub. Date: Dec. 28, 2000

(30) Foreign Application Priority Data

Jun. 22, 1999 (DK) ..... 1999 00890

(51) Int. Cl.[7] ..... B41F 31/00
(52) U.S. Cl. ..... 101/350.6; 101/169; 101/363
(58) Field of Search ..... 101/350.6, 363, 101/364, 366, 367, 169

(56) References Cited

U.S. PATENT DOCUMENTS

| | | | | |
|---|---|---|---|---|
| 2,914,788 A | | 12/1959 | Smith et al. | |
| 3,085,275 A | | 4/1963 | Allison | |
| 3,309,992 A | | 3/1967 | Motter | |
| 3,730,087 A | | 5/1973 | Trant et al. | |
| 3,866,266 A | | 2/1975 | Dunlap | |
| 3,878,780 A | * | 4/1975 | Lotte | 101/119 |
| 3,882,817 A | | 5/1975 | Zink | |
| 3,952,650 A | | 4/1976 | Lotte | |
| 4,040,349 A | * | 8/1977 | Jeschke | 101/365 |
| 4,078,486 A | | 3/1978 | Moser | |
| 4,315,425 A | * | 2/1982 | Zbornik et al. | 72/481.2 |
| 4,561,163 A | | 12/1985 | Cox | |
| 4,821,672 A | | 4/1989 | Bruno | |
| 4,938,131 A | | 7/1990 | Maggi | |
| 4,940,354 A | | 7/1990 | Holderegger et al. | |
| 5,081,950 A | | 1/1992 | Martin et al. | |
| 5,341,741 A | | 8/1994 | Schneider et al. | |
| 5,406,887 A | | 4/1995 | Hertel et al. | |
| 5,410,961 A | * | 5/1995 | DeNicola et al. | 101/363 |
| 5,483,885 A | | 1/1996 | Leineweber | |
| 5,517,918 A | | 5/1996 | Van Denend | |
| 5,642,664 A | | 7/1997 | Schneider | |
| 5,656,083 A | | 8/1997 | Schönberger | |
| 5,740,735 A | * | 4/1998 | Xydias et al. | 101/169 |
| 5,765,480 A | * | 6/1998 | Toyoda | 101/169 |
| 5,983,798 A | * | 11/1999 | Iijima et al. | 101/169 |
| 6,202,252 B1 | * | 3/2001 | Harrisson | 101/169 |
| 6,293,195 B1 | * | 9/2001 | Allison, Jr. | 101/350.6 |

FOREIGN PATENT DOCUMENTS

| | | |
|---|---|---|
| DE | 2500764 | 7/1975 |
| DE | 9017689 | 9/1991 |
| DE | 4421350 | 12/1995 |
| DE | 29611194 | 10/1996 |
| DE | 29709301 | 1/1998 |
| EP | 0 402589 | 12/1990 |
| EP | 0 611649 | 8/1994 |
| GB | 1306654 | 2/1973 |

* cited by examiner

*Primary Examiner*—Eugene H. Eickholt
(74) *Attorney, Agent, or Firm*—James Creighton Wray; Meera P. Narasimhan

(57) ABSTRACT

A doctor blade system with clamping device is provided for clamping a doctor blade, for example, in a doctor blade chamber without using screws and without having to use tools. A clamping mechanism, preferably pneumatic, counteracts the clamping by actuation. By disposing a sectional rail between the clamping rail and the doctor beam, the sectional rail drawing the clamping rail and the beam together with a spring mechanism, the doctor blade is clamped between the clamping rail and the beam. In another embodiment, the clamping rail is designed as an angular section tipping about an edge.

18 Claims, 14 Drawing Sheets

DOCTOR BLADE SYSTEM

BACKGROUND OF THE INVENTION

The present invention concerns a doctor blade system for printing units as described in the preamble of claim 1. Also, the invention concerns a clamping device for a doctor blade.

In the present application, the invention will be explained specifically in connection with doctor blade chambers but may also be utilised in other doctor blade systems where a doctor blade is secured between a beam and a doctor rail.

In rotating printing units for offset printing, flexo printing etc. there is advantageously used systems including so-called doctor blade chambers. A doctor blade chamber is an ink container which by means of so-called doctor blades fits tightly to an ink transfer roller, and from which container ink is transferred to this roller, often a raster roller transferring the ink to further rollers forming a part of the printing process.

The doctor blade chamber, which may be several meters long, consists mainly of a doctor beam constituting the wall of an ink chamber, in the front side of which, facing the roller, there is an open channel and two or more doctor blades clamped onto the doctor beam. These doctor blades are thin, elongate blades having one longitudinal side firmly connected to the doctor beam and with their opposite sides resting under a certain spring force against the roller.

Often two doctor blades are used in the doctor blade chamber system, where one doctor blade serves for sealing for the ink chamber against the roller, and the other serves for sealing the ink chamber against the roller as well as supplying the roller with an even layer of ink; these functions are advantageous as compared with system where the roller collects ink from an open ink container as in that case it is difficult to achieve an even and precise ink transfer. Besides, an open ink container has the disadvantage that a part of the ink is sprayed around the roller at the collection due to the great speed of the roller, thereby contaminating the printing unit.

The doctor blades, which, in spite of this common name, may also be made of synthetic material, are wear parts in a printing unit. A doctor blade is a thin blade resting on the ink transfer roller, for example the raster roller.

Depending on the quality of the roller and on the ink, a doctor blade lasts between one day and several weeks after which it has to be replaced. For replacing the doctor blade, according, to prior art the doctor blade chamber usually has to be taken out of the printing unit which is a disadvantage. After demounting a clamping rail disposed on the beam of the doctor blade chamber and keeping the doctor blade clamped between the rail and the bean, the doctor blade may be replaced after which the clamping rail may be mounted again.

According to prior art, this clamping rail is screwed onto the doctor blade chamber beam with a number of screws, implying some disadvantages. First, quite a number of screws (10 screws per meter of doctor blade chamber) have to be loosened and tightened, making the replacing process slow. Second, it is a well-known problem that the clamping rail does not clamp quite evenly on the doctor blade as the screw system implies a raised pressure right around the screws. The consequence is that the doctor blade does not lie evenly to the roller but "flickers", i.e. has shape like a wave. These variations in distance between the doctor blade and the roller, even though they are very small—in the magnitude of few micron—, result in the application of ink on the roller not being quite even, thereby depreciating the printing quality. Furthermore, at the areas between the screws ink may penetrate between the doctor blade and the clamping rail and between the doctor blade and the doctor beam, further enhancing the "flickering" effect and requiring frequent cleaning. Third, tools are required for loosening and tightening the screws. During work it may be a great source of irritation for the workers if this tool is not available for the replacement, for example because a colleague has mislaid it.

A quick replacement of the doctor blade is achieved with a mechanism as described in American patent U.S. Pat. No. 5,517,918 where the doctor blade is secured by means of a couple of leaf springs. The leaf springs overlap some of the doctor blade and is prestressed so that the doctor blade is pressed against the beam. By replacing the doctor blade there is used a displacing mechanism in the form of a resilient tube, which may be expanded automatically whereby the springs are pushed away from the doctor blade which is thereby loosened.

This mechanism has the disadvantage that the springs are fastened by a row of screws in analogy to the holding of the clamping rail in traditional doctor blade chambers. As the springs are a lot thinner that traditional clamping rails, the above flicker-effect is still more pronounced than in traditional printing units, making this system unsuitable for print where high quality is demanded.

Another system has been described in American patent U.S. Pat. No. 3,085,275 where the doctor blade is secured between the clamping rail and the beam by the force from a pneumatic expanding tube is transferred to the clamping rail by means of a tip mechanism. In this system it is not the holding mechanism itself which causes flickering in the doctor blade but a guide rail provided on the doctor blade, the guide rail being fastened with screws to the doctor beam. Furthermore, in this system it is disadvantageous that the doctor blade is fastened to a rail which together with the doctor blade has to be pushed laterally out of the chamber when changing doctor blade. As printing units may be very long, much space beside the printing unit is required. A further drawback is that the printing unit only functions satisfactorily if there is sufficient pneumatic pressure. By pressure failure the printing unit will not be able to work satisfactorily any more.

Different pressure systems exist where the doctor blade is clamped between the clamping rail and the beam without flicker appearing. Such a system is described in American patent publication U.S. Pat. No. 4,938,131. By pneumatic expansion of a flexible tube, the clamping rail is pressed against the doctor beam whereby the doctor blade is secured therebetween. This system has, however, the great disadvantage that the doctor blade is no longer secured if failure of the pneumatic supply occurs. This implies a great risk of danger as the doctor blade, due to the rotating printing roller, may be flung out of the doctor with great speed with risk of damage to equipment and people around the printing unit.

SUMMARY OF THE INVENTION

The purpose of the invention is to provide a doctor blade chamber with a clamping device for doctor blades which does not have the above drawbacks.

This purpose is achieved with the present invention by a doctor blade system of the kind mentioned in the introduction, and which is peculiar as described in the characterising part of claim 1.

Such a clamping device may be used in doctor chambers with a doctor blade, e.g. single doctor blades for use in intaglio or screen process printing, or in doctor devices with two or more doctor blades, e.g. doctor blade chambers for rotary printing.

By designing the beam of the doctor blade chamber and the clamping rail with a groove, preferably T-shaped, in which there is mounted a suitable, for example T-shaped, sectional rail, there is achieved a continuous connection between the clamping rail and the beam not having the drawbacks of the previously described pointed connection where screws are used.

To achieve clamping of the doctor blade, the beam is designed with a groove in which the sectional rail may be displaced in direction against the bottom of this groove so that by this displacement a clamping of the doctor blade between the clamping rail and the doctor blade chamber is effected. The trouble implied in loosening and tightening the row of screws is avoided by this device.

In practice, the displacement of the sectional rail is effected in the way that, for example, there is inserted one or more wave springs between the inner wall of the beam groove, i.e. the wall opposite to the bottom of the groove, and the sectional rail so that the spring or springs press the sectional rail in direction against the bottom of the beam groove. Thereby the doctor blade is clamped between the clamping rail and the beam.

The wave springs may also be substituted by elastic polymers, e.g. designed as a tube (rubber tube) or a foam polymer. It is crucial that eventually a force action is achieved so that it is clamped between the clamping rail and the beam.

In order to loosen the doctor blade again from its clamped position, the sectional rail in the beam is to be pushed in direction away from the bottom of the beam groove. This is achieved with a displacing mechanism in the doctor blade chamber which by actuation counteracts the force of the springs and thereby presses the sectional rail in the beam groove away from the bottom of the beam groove.

In practice, this is achieved by e.g. filling the space between the sectional rail and the bottom of the beam groove with gas under high pressure, e.g. pressurised air. In order that overpressure may be maintained in this space, the ends of the beam groove is sealed with specially designed packings.

Another possibility is to dispose a resilient tube, e.g. a rubber tube, in the interspace between the sectional rail and the bottom of the beam groove which may be expanded pneumatic or hydraulic in order thereby to counteract the force of the springs.

A further possibility, which is mechanical, is to place a rigid, oval tube being rotatable about its longitudinal axis in the interspace between the sectional rail and the bottom of the groove. By turning the tube the distance between the sectional rail and the bottom of the beam groove is increased.

A suitable feature in the invention is that the clamping of the doctor blade is passive and that the displacing mechanism is active when the doctor blade is loosened from its clamped position in the sense that an action has to be performed, e.g. filling of the interspace with pressurised air or using pneumatics or hydraulics for loosening the doctor blade. This principle has been chosen out of safety considerations as this is advantageous as compared with a device, e.g. hydraulic, where the doctor blade is secured by an active process. By an active clamping device there will be the possibility of the doctor blade suddenly not being clamped any more by pressure failure in the pneumatics or hydraulics, whereby there is the possibility that the razor-sharp doctor blades are flung out of the printing unit and across the print shop, implying danger for the persons around the printing unit.

In a further embodiment of the sectional rail, the side engaging the clamping rail has an edge designed with cross-section as a hook; thereby the clamping rail may be lifted free of the sectional rail when the sectional rail is pressed out of the groove by the pneumatic, hydraulic or mechanical displacing mechanism. This design is advantageous when the interspace between the clamping rail and the doctor beam is to be cleaned as time-consuming demounting and mounting is avoided.

In a further embodiment of the invention, the sectional rail is resilient and designed so that the elastic force itself in the sectional rail draws the clamping rail toward the beam whereby the doctor blade is clamped. For counteracting the effect of the elastic sectional rail when doctor blade is to be exchanged, the above displacing mechanism is pneumatic or hydraulic. As mechanical alternative in this case it is, however, possible to use an oval, rigid tube being rotatable about its longitudinal axis.

In a further development, the elastic sectional rail is designed in two parts that are pushed into the beam groove from each their end of the beam groove. The lengths of the two parts are chosen in such a way that their ends are in contact with each other in the groove of the doctor beam. This design has the advantage of these two parts furthermore each being able to be designed with a sealing at one end so that the beam groove is sealed at the ends when the elastic sectional rail is provided therein. In this way it is ensured that ink and dirt are prevented from entering at the ends in the beam groove and that the overpressure may be maintained in the interspace between the sectional rail and the bottom of the beam groove when the above mentioned displacing mechanism in the design where the interspace is filled with gas under high pressure is used for pressing the sectional rail away from the bottom of the beams groove when the doctor blade is to be demounted.

In a further embodiment of the invention, the doctor beam is designed with an inner chamber extending along the beam in the part of the beam on which the clamping rail is mounted for clamping the doctor blade. This inner chamber has a resilient wall being the one bearing against the clamping rail. The elastic force in this wall draws the wall inward toward the inner chamber. The elastic wall has a sectional bead at its outer side, e.g. T-shaped or dovetailed, for engaging a correspondingly designed groove in the clamping rail. Additionally, the clamping device comprises a displacing mechanism which by actuation presses this resilient wall outward so that the clamping rail may be mounted with the sectional edge of the elastic wall engaging the groove of the clamping rail. By deactuation of this displacing mechanism, the wall is again drawn inward against the inner chamber whereby the clamping rail is drawn toward the beam and the doctor blade is clamped between the clamping rail and the beam.

This displacing mechanism may be provided by filling the inner chamber with gas or liquid under high pressure for counteracting the elastic, inward directed force. Another possibility is to provide an elastic tube in the chamber, which tube may be expanded pneumatic or hydraulic. A third possibility is to provide a rigid, oval tube being rotatable about its longitudinal axis in the chamber which by rotation presses the wall outward so that the clamping rail is loosened from its clamping.

The making of the doctor beam with an inner chamber may, for example, occur by extruding the beam in metal or synthetic material.

Alternatively, the inner chamber may be provided by making the beam with a groove which is then covered with an elastic rail having an elastic force inward toward the beam groove. At its outer side, the rail is equipped with a sectional bead, for example T-shaped or dovetailed, for engaging a corresponding groove in the clamping rail.

In a further embodiment of the invention, the clamping rail is designed with an edge along the clamping rail. The clamping rail is placed on the beam so that the edge of the rail engages a groove on the beam suitably shaped thereto, and so that the clamping rail may tip about this edge.

Between a first part of the clamping rail and the beam there is provided an elastic, oval tube which by its elastic force presses this first part away from the beam whereby the clamping rail tips about the edge and the second part of the clamping rail presses against the beam whereby the doctor blade is clamped between this second part and the beam. For loosening the doctor blade from the clamped position, the elastic, oval tube may be filled with gas or liquid which subjected to high pressure reduces the ovality of the tube, i.e. it becomes more round, resulting in the distance between the first part of the clamping rail and the beam is reduced whereby the doctor blade is no longer clamped. The elastic tube may now easily be removed from the doctor blade chamber whereafter also the clamping rail may be removed without requiring further demounting. Therefore, this design is very suitable when the interspace between the clamping rail and the beam is to be cleaned.

As substitution for the use of a pneumatic or hydraulic deformable tube between the first part of the clamping rail and the beam, a rigid, oval tube may be used. In this case, the distance between the first part of the clamping rail and the beam may be changed by turning the tube about its longitudinal axis. Suitably, at handle is used thereto. In order that this handle is not by actuated by accident, resulting in loosening of the doctor blade, the tube is turned more than its upper dead point, i.e. the position where there is maximum distance between the clamping rail and the beam. Even by very little sliding resistance, for example because of ink between the tube and the clamping rail or the beam, respectively, the tube will not unsuitably turn by itself, thereby loosening the doctor blade, as a force has to be exerted actively for turning the tube over the dead point for loosening the doctor blade.

In a further design, the handle is disposed displacing on the tube, and the doctor blade chamber beam has been provided with a hole in which the handle may be provided when it is not in use. In this way it is prevented that the handle is actuated by mistake so the doctor blade is loosened. In order that the handle does not unsuitably slide out of the hole, the hole is e.g. provided with a ball lock. This ensures that the doctor blade is retained until an action is performed for loosening the doctor blade.

The tube with handle may advantageously be designed so that in two opposite positions it causes loosening of the doctor blade but only in one position it is possible to push the tube out of the doctor blade chamber. In this way it is ensured that the tube with the handles in position for loosening the doctor blade does not unsuitably slide out of the doctor blade chamber.

In a further embodiment, the handle on the rigid, oval tube is disposed pivotable as well as sliding on the tube so that it may be pushed into the tube itself when the handle is not in use. In order that the handle does not unsuitably slide out of this hole, the hole is, for example, provided with a ball lock.

For practical reasons the tube may be designed in two parts that are pushed into the doctor blade chamber from each their end.

A design using a tube with handles will preferably find application for doctor blade chambers of lesser width, typically 1–1.5 m, while for wider doctor blade chambers it is an advantage to use the solution including pneumatics or hydraulics, possibly in connection with resilient tubes.

A further advantage by the said designs is that the doctor blade chamber is not to be demounted from the printing unit when the doctor blade is to be replaced. Thereby the replacing procedure becomes easier and quicker.

The invention is explained more closely in the following with reference to the drawing, where

DETAILED DESCRIPTION OF THE PREFERRED EMBODIMENTS

Figure 1:
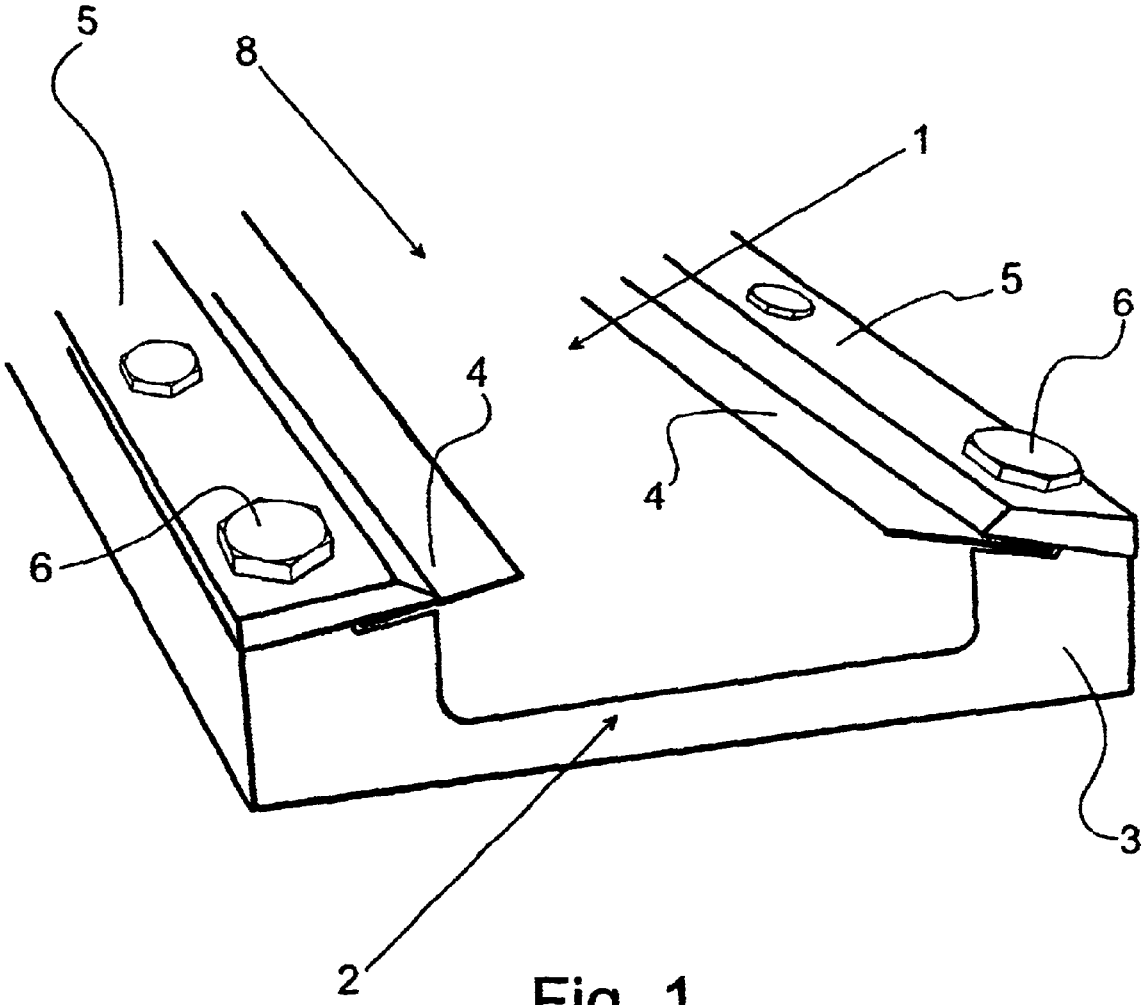
Fig. 1 PRIOR ART
FIG. 1 shows in perspective view a part of a doctor blade chamber according to prior art.

FIG. 1 is a perspective draft of a part of a doctor blade chamber 1 according to prior art For the sake of illustration, the doctor blade chamber 1 is shown without end casing normally sealing off the end part 2 so that the ink does not run out of the doctor blade chamber 1. Besides the not shown end casings, the doctor blade chamber 1 consists of a beam 3 on which is fitted a doctor blade 4 clamped between a clamping rail 5 and the doctor blade 3. Clamping rails 5 are screwed firmly onto the doctor beam 3 with screw bolts 6. Together with the doctor blades 4, the beam 3 of the doctor blade chamber constitute the wall of the ink chamber 7. The open channel 8 between the doctor blades 4 is shut off when the doctor blade chamber 1 is adjusted toward the ink transfer roller.

Figure 2:
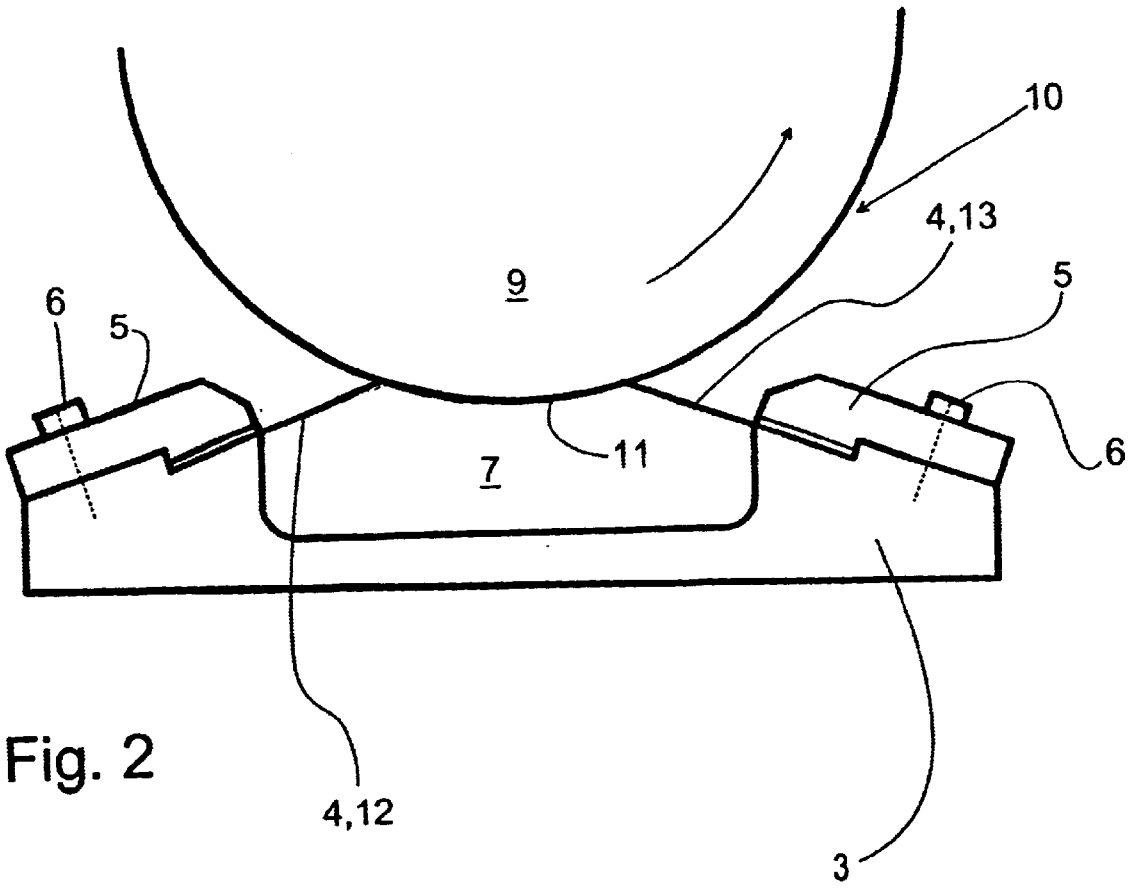
Fig. 2 PRIOR ART
FIG. 2 shows a cross-section of a doctor blade chamber according to prior art.

FIG. 2 is a cross-section through the doctor blade chamber 1 according to prior art and an ink transfer roller 9. Together with the two doctor blades 4 touching the surface 10 of the roller, the ink chamber 7 is largely closed. When the ink transfer roller 9 rotates about its axis, the part of the roller 11 inside the ink chamber 7 collects ink which it gives off to other rollers in the printing unit. According to prior art, the clamping rails 5 are screwed to the doctor beam 3 with screw bolts. Depending on their arrangement, the doctor blades 4 are designated blocking blade or sealing blade 12 for the doctor blade 4 on the side where the ink transfer roller 9 moves towards the ink chamber 7 and working blade 13 for the doctor blade 4 on the side where the ink transfer roller 9 moves in direction away from the doctor blade chamber 7, respectively.

Figure 3:
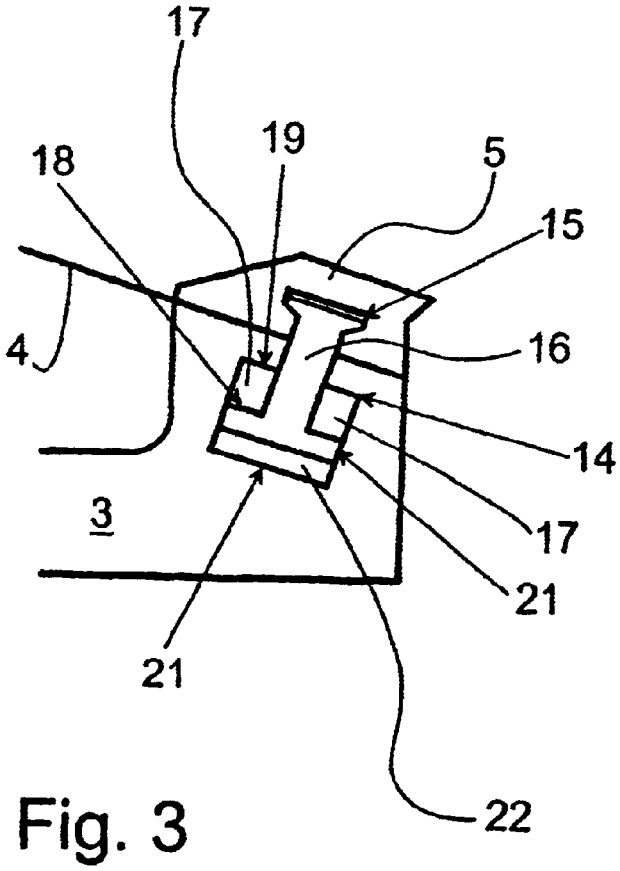
FIG. 3 shows a cross-section of a part of the doctor beam in an embodiment according to the invention where wave springs are used in the device.
Figure 3:
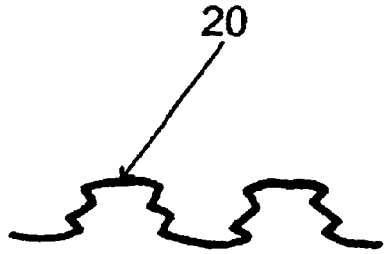

FIG. 3 shows a cross-section through one side of the doctor beam 3 in an embodiment according to the invention for fixing a doctor blade 4, where in the device wave springs 20 are used. Furthermore, on the Figure there is shown a part of a wave spring 20 in a possible design. The beam 3 of the doctor blade chamber is designed with a T-shaped groove 14, and the clamping rail 5 is designed with a groove 15 which is mainly T-shaped. The latter groove is could also be T-shaped. The sectional rail 1 is designed so that it fits in the two grooves 14 and 15 so that the doctor beam 3 and the clamping rail 5 are connected by mounting the sectional rail 16. In the interspaces 17 between one T-shaped side 18 of the sectional rail and the inner edge 19 of the groove 14 of the doctor beam, the inner edge 19 being the edge opposite to the bottom 21 in the beam groove 14, there is provided a wave spring 20 (not shown in the interspace 17 but shown to the right in the Figure in longitudinal section) pressing the inner edge 19 of the doctor beam groove 14 and the first T-shaped side 18 of the sectional rail from each other so that the sectional rail 16 is displaced inward toward the bottom 21 of the groove. Hereby there is exerted a force on the clamping rail 5 against the doctor beam 3 whereby the doctor blade 4 is clamped therebetween. For counteracting the spring force and for moving the sectional rail 16 in direction away from the bottom 21 of the groove, which is suitable when the doctor blade 4 is to be loosened for replacement, the doctor beam 3 according to the invention may be provided with a displacing mechanism (not shown) whereby the interspace 22 between the sectional rail 16 and the bottom 21 of the beam groove may be filled with gas under high pressure. This requires that the T-section of the sectional rail inside the groove of the doctor beam is sealing off so well against the side walls 23 of the beam groove that an overpressure can be maintained in the interspace 22 between the sectional rail 16 and the bottom 21 of the beam groove as compared with the interspace 17 between the first T-shaped side 18 of the sectional rail and the inner edge 19 of the doctor beam groove 14.

Alternatively, liquid may also be utilised for the purpose. Especially for liquid it is an advantage that the interspace 22 between the sectional rail 16 and the bottom 21 of the beam groove is filled out by a fluid tube 24 as shown in FIGS. 4*a* and 4*b* which may be filled and emptied with gas or liquid under high pressure for counteracting the spring force.

Figure 4A:
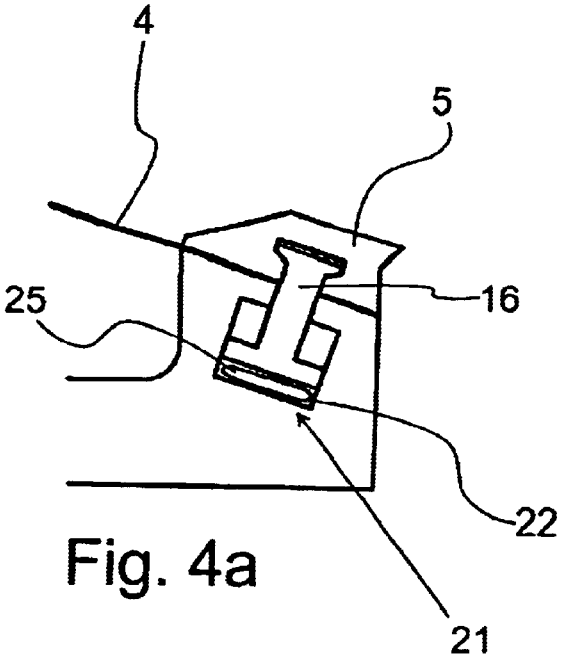
FIG. 4 shows a cross-section of a part of the doctor beam in an embodiment according to the invention where in the displacing mechanism there is used a resilient tube which may be expanded pneumatic or hydraulic for counteracting the spring force or where a rigid, oval tube rotatable about its longitudinal axis is used.
Figure 4B:
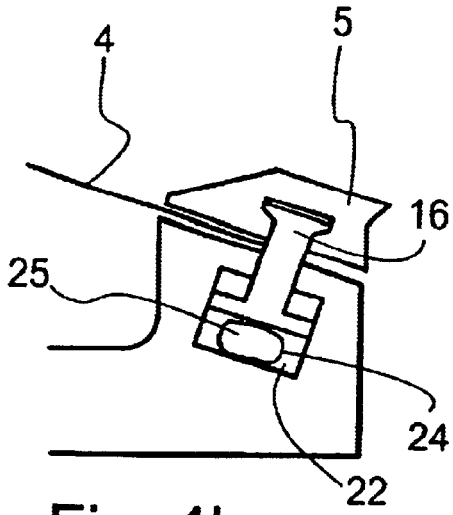

FIGS. 4*a* and 4*b* show a cross-section through one side of the doctor beam 3 in an embodiment according to the invention for fixing a doctor blade 4 as described under FIG. 3 but where there is supplemented with a further displacing mechanism comprising a resilient fluid tube 24 in the interspace 22 between the sectional rail 16 and the bottom 21 of the beam groove, where the inner volume 25 of the resilient fluid tube 24 may be filled with gas or liquid which under high pressure expands this resilient fluid tube 24 (see FIG. 4*b*) and counteracts the spring force whereby the sectional rail 16 is pressed away from the beam groove bottom 21. Thereby the doctor blade 4 is no longer clamped between the clamping rail 5 and the doctor beam 3 and may be taken out of the doctor blade chamber 1.

Figure 4C:
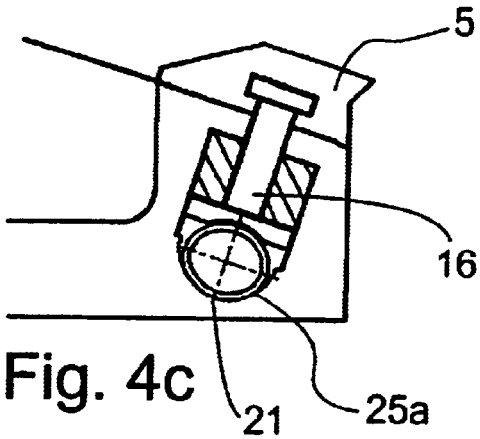
Figure 4D:
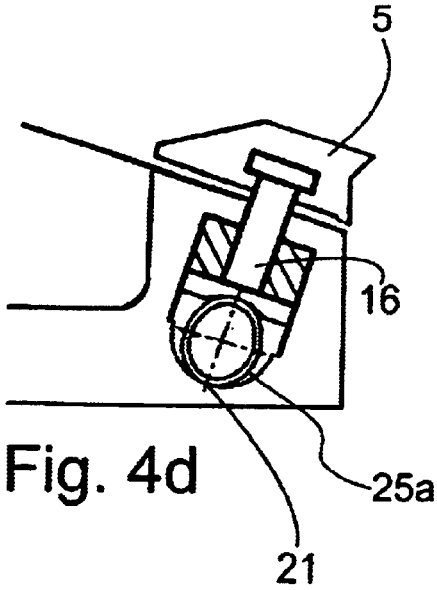

As alternative to the resilient tube, a rigid, oval tube 25*a* being rotatable about its longitudinal axis disposed between the beam groove bottom 21 and the sectional rail 16, see FIGS. 4*c* and 4*d*, may be used. By rotating the tube 25*a*, the sectional rail 16 is pressed away from the beam groove bottom 21, whereby the clamping rail 5 is loosened from its clamping action.

Figure 5:
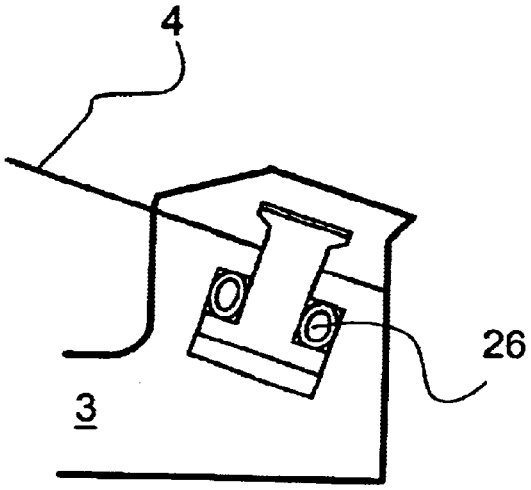
FIG. 5 shows a cross-section through the beam in an embodiment according to the invention where a resilient tube is used instead of wave spring in the device.

FIG. 5 shows a cross-section through one side of the doctor beam in a further embodiment according to the invention for clamping a doctor blade 4. In this embodiment, the wave spring in the device has been substituted by a resilient polymer tube 26, for example a rubber tube. In this embodiment of the clamping device, the displacing mechanism for counteracting the spring force as described under FIG. 4 may also be used.

Figure 6:
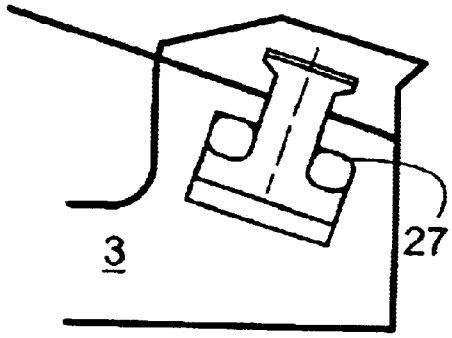
FIG. 6 shows a cross-section through the beam in an embodiment according to the invention where in the device there is used a foam polymer instead of wave springs.

FIG. 6 shows a cross-section through a part of one side of the doctor beam in a further embodiment according to the invention for fixing a doctor blade. In this embodiment, the wave spring in the device has been substituted by an elastic section of foam polymer 27. In this embodiment, the displacing mechanism for counteracting the spring force as described under FIG. 4 may also be used.

Figure 7:
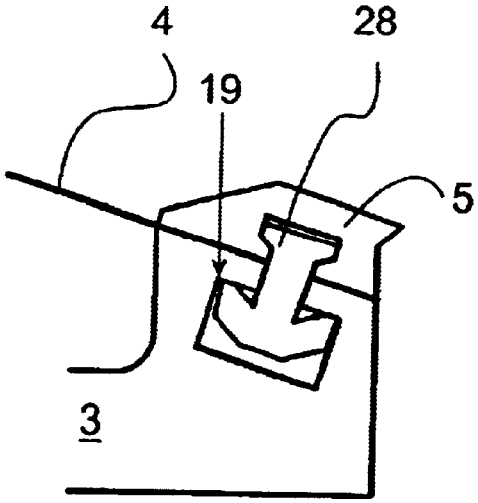
FIG. 7 shows a cross-section through the beam in an embodiment according to the invention where an elastic sectional rail is used in the device.

FIG. 7 shows a cross-section through a part of one side of the doctor beam in a further embodiment where the static sectional rail in the clamping device and the spring in the device have been substituted by a resilient, deformable sectional rail 28. The resiliency in this rail 28 results in a force between the sectional rail 28 and the edge 19 in the groove of the beam so that the clamping rail 5 is pressed against the doctor beam 3 whereby the doctor blade 4 is clamped therebetween. In this embodiment, the displacing mechanism for counteracting the spring force as described under FIG. 4 may also be used. Furthermore, the resilient sectional rail 28 may be designed in manny othere ways.

Figure 8:
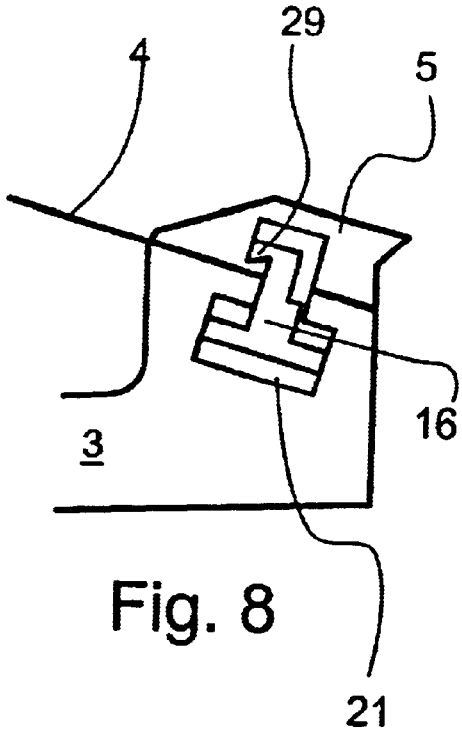
FIG. 8 shows a cross-section through the beam in an embodiment according to the invention where the sectional rail is shaped so that the clamping rail may be lifted free of the doctor blade chamber in an easy way.

FIG. 8 shows a cross-section through a part of one side of the beam in a further embodiment according to the invention for fixing a doctor blade 4. The sectional rail 16 in the clamping device is designed with an edge 29 which is similar to a hook in cross-section engaging the clamping rail 5 so that the clamping rail 5 may be lifted free of the sectional rail 16 when, by means of the displacing mechanism, this is pressed outward in direction away from the bottom 21 of the beam groove. This embodiment is an advantage as mounting and demounting of the clamping rail 5 may be performed easily and quickly, e.g. when the interspace between the doctor blade 4 and the clamping rail 5 or between the doctor blade 4 and the doctor beam 3 is to be cleaned.

FIG. 9 shows a cross-section through one side of the doctor beam 3 which is designed with an inner chamber 39 along the beam 3. One wall 40 of the inner chamber 39 is elastic with a force which is directed inward against the inner chamber 39 in such a way that the wall 40 curves inward as shown on FIG. 9*a*. This elastic wall 40 has sectional bead 42 at its outer side 41, for example T-shaped or dovetailed, for engaging a corresponding groove in the clamping rail. The doctor blade chamber has also a displacing mechanism so that the elastic wall 40 by actuation of the displacing mechanism is pressed outward whereafter the clamping rail 5, which is to clamp the doctor blade 4 against the doctor beam 3, may be fitted as illustrated in FIG. 9*b*. After deactuation of the displacing mechanism, illustrated in FIG. 9*c*, the clamping rail 5 is drawn toward the doctor beam 3 by the force directed against the inner chamber 39 whereby the doctor blade 4 is clamped between the clamping rail 5 and the doctor beam 3.

The doctor beam 3 may, for example, be designed with an inner chamber 39 by the doctor beam 3 being made by extrusion, for example in aluminium or synthetic material.

Figure 9A:
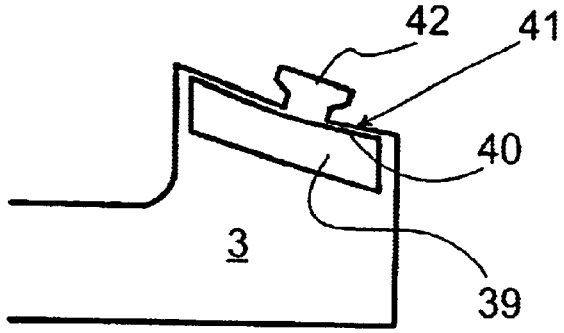
FIG. 9 shows a cross-section through the beam with an inner chamber having a resilient wall with a sectional bead for engaging the clamping rail.
Figure 9B:
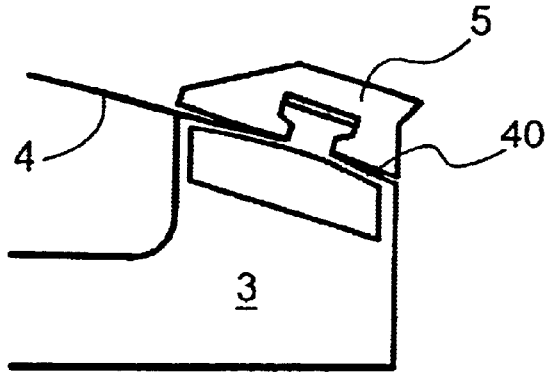
Figure 9C:
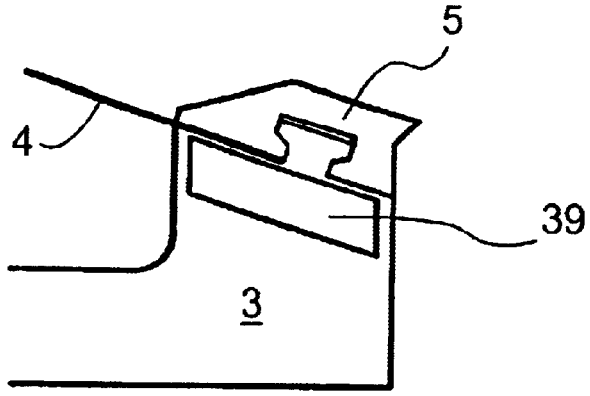
Figure 9D:
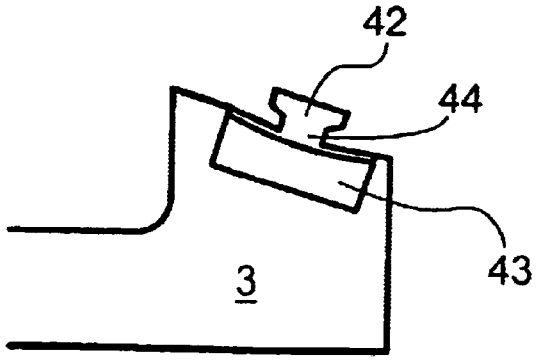

Another possibility for designing the beam with an inner chamber, see FIG. 9*d*, is to design the beam 3 with a groove 43 which is then covered with an elastic rail 44, for example of synthetic material or metal. The rail 44 is designed-with a sectional bead 42, for example T-section, for engaging the clamping rail 5.

Figure 10A:
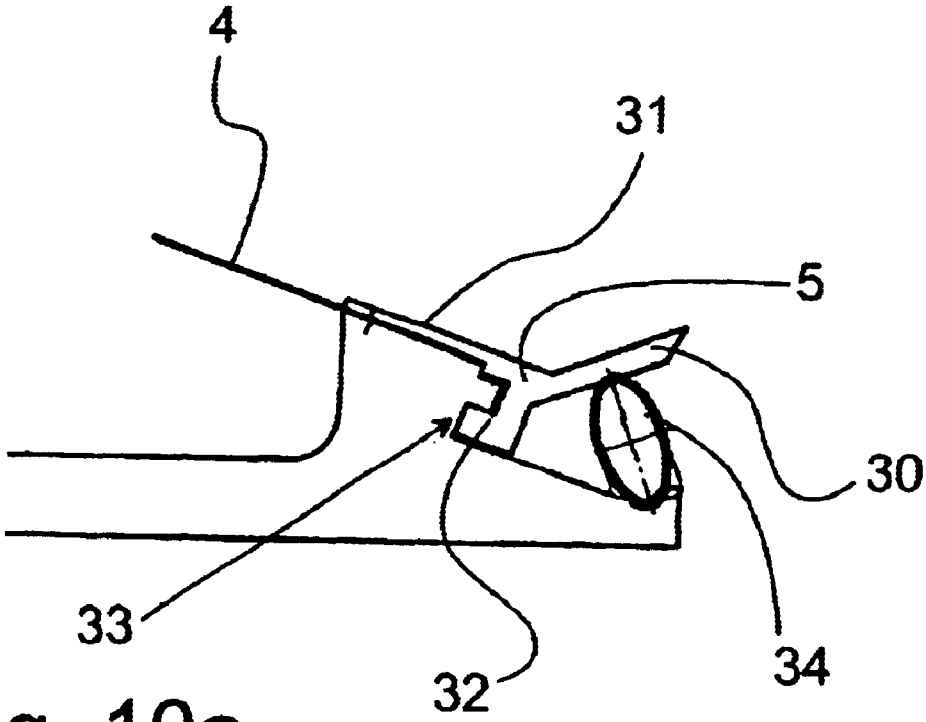
FIG. 10 shows a cross-section through the beam in an embodiment according to the invention where the clamping rail is shaped as an angular piece, and where a resilient, oval tube forms a part of the clamping device.
Figure 10B:
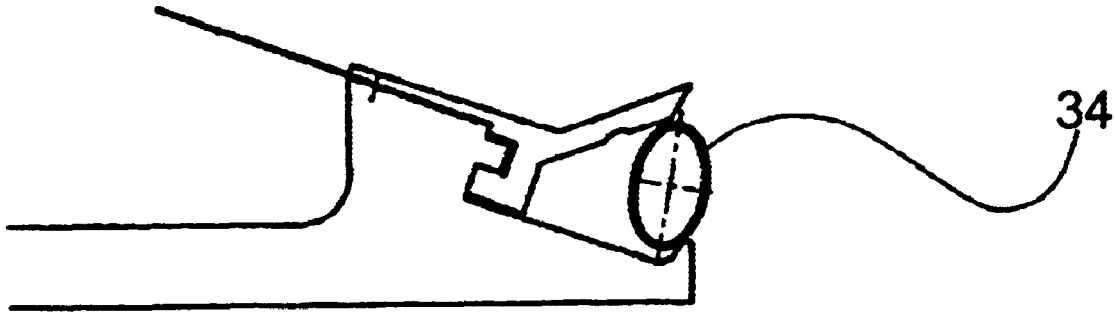

FIG. 10*a* shows a further embodiment of the clamping device for the doctor blade. A clamping rail 5, which is designed as an angular piece with a first part 30 and a second part 31 and an edge 32, is disposed on the beam 32, engaging a groove 33 formed in the beam for this purpose. Between the first part 30 of the clamping rail and beam 3, a resilient, oval tube 34 exerts a force so that the first part 30 of the clamping rail and a groove 45 in the beam 3 are pressed away from each other, whereby the force via the edge 32 is transmitted to the second part 31 of the clamping rail which is pressed against the beam 3 and thereby clamps the doctor blade 4 between the second part 31 of the clamping rail and the beam 3. The ovality of the resilient tube 34 may be reduced by the tube 34 being filled with gas or liquid under high pressure. The reduction of the ovality effects a reduction of the force action on the doctor blade 4. By sufficient reduction of the ovality of the tube 34, the doctor blade 4 is no longer clamped between the clamping rail 5 and the beam 3 and may be taken out of the doctor blade chamber. By further reduction of the tube ovality, it will be possible to demount the tube 34 from the doctor blade chamber, see FIG. 10*b*.

Figure 11A:
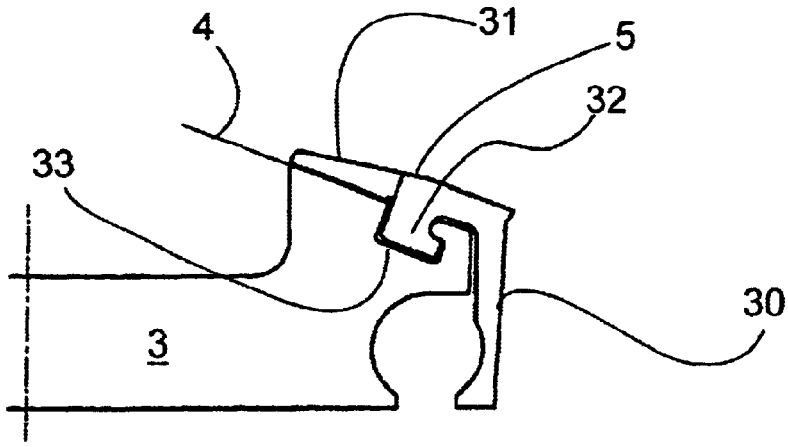
FIG. 11 shows a second embodiment of the invention where the clamping rail is designed as an angular piece and where a rigid, oval tube forms a part of the clamping device.
Figure 11B:
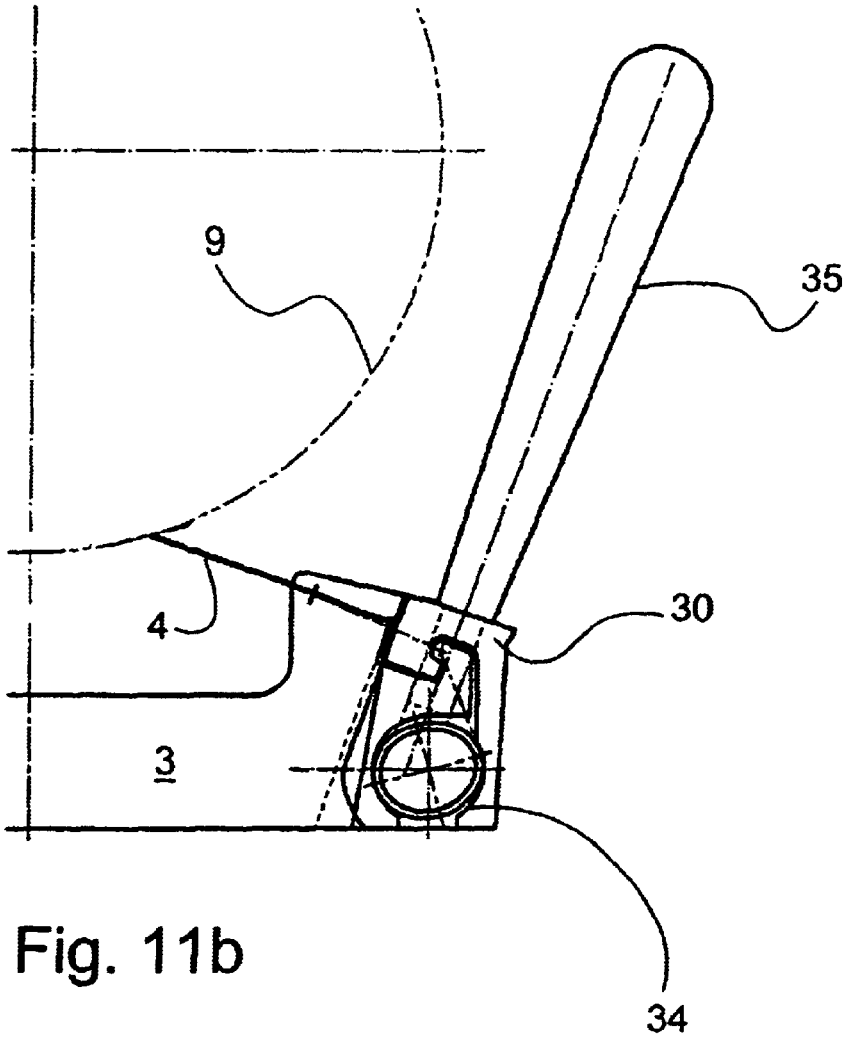
Figure 11C:
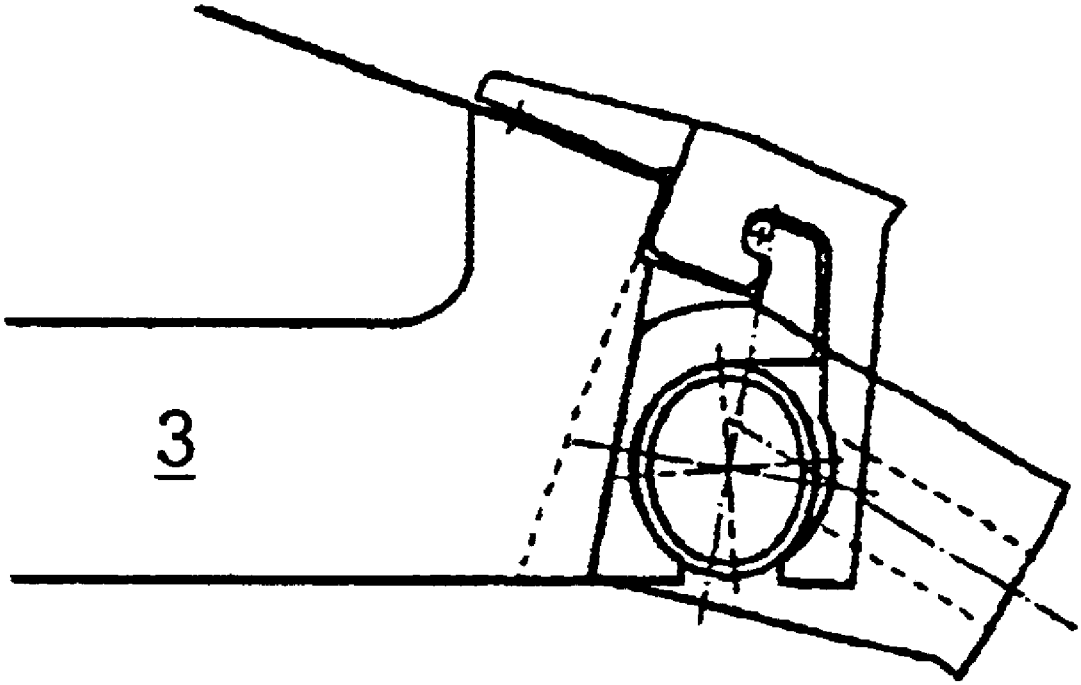

FIG. 11 shows a further embodiment for the holding mechanism for the doctor blade 4. A clamping rail 5 designed as an angular piece with a first part 30, a second part 31 and an edge 32 is disposed on the beam 3 with the edge 32 engaging a groove 33 formed in the beam for this purpose, see FIG. 11*a*. Between the first part 30 of the clamping rail and a groove 45 in beam 3, there is disposed a rigid, oval tube 34 with a handle 35, see FIG. 11*b*. When the doctor blade 4 is to be clamped, the tube 34 with handle 35 is turned against the roller 9 or, if this is more suitable, in the opposite direction until the doctor blade 4 is clamped. The clamping rail 5 is resilient to a certain degree so that the tube 34 may not only be turned until the doctor blade 4 is clamped but a further distance past the dead point for maximum distance between the second part 31 of the clamping rail and the beam 3. Thereby it is ensured that the handle 35 is not unsuitably loosened by e.g. vibrations in the printing unit, especially if the friction is between the tube 34 and the groove 45 and between the tube 34 and the first part 34 of the clamping rail are reduced because of spilled ink. Thus an action has to be performed for loosening the doctor blade where the tube is turned by means of the handle in a position about 90° from the clamping position (see FIG. 11*c*).

Figure 12:
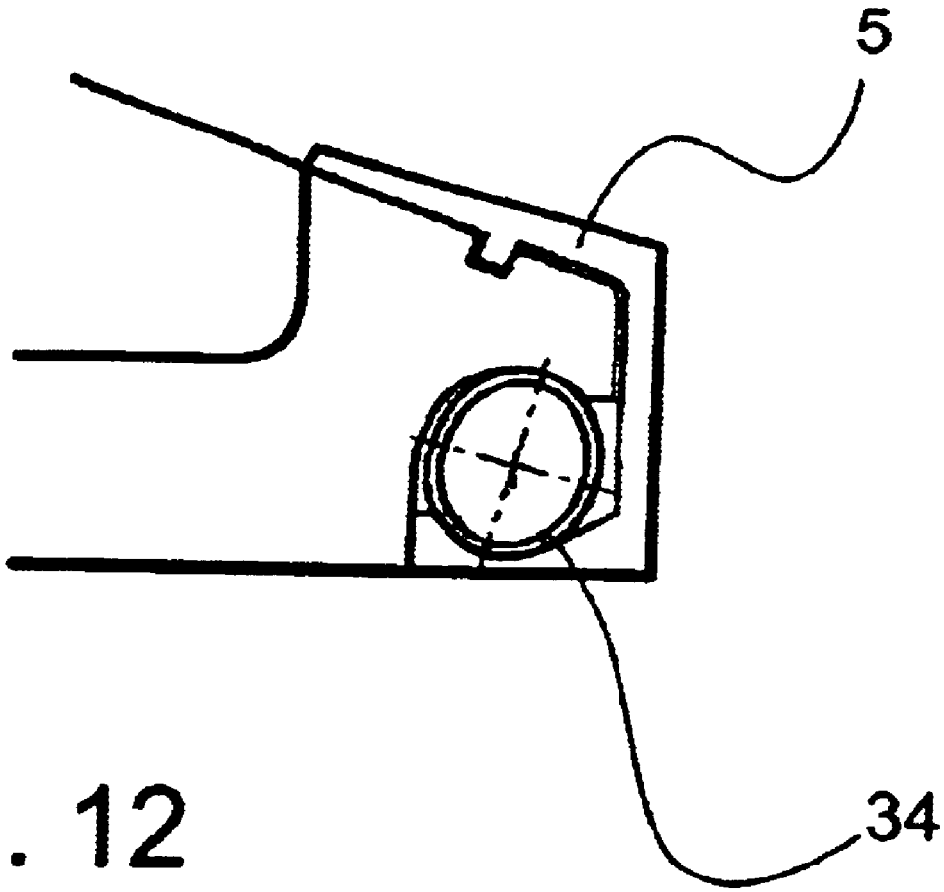
FIG. 12 shows a further embodiment of the invention where the clamping rail is shaped as an angular piece, and where an oval tube forms a part of the clamping device.

FIG. 12 shows a further embodiment of the clamping rail 5 and the beam 3 where between there is disposed a rigid, oval tube 34 being rotatable about its longitudinal axis in analogy with the tube described under FIG. 11. As alternative one could also use an elastic tube with variable ovality as described under FIG. 10.

FIG. 13 shows a further development of the embodiment of the invention described in FIG. 11. In FIG. 13*a* the rigid, oval tube 34 is mounted and turned into a position where it is not exerting any force between the clamping rail 5 and the beam 3 and the doctor blade 4 is not clamped between the clamping rail 5 and the beam 3. By means of the handle 35, the tube 34 may be turned about its longitudinal axis whereby the distance between the first part 30 of the clamping rail and the beam 3 is increased so that the doctor blade 4 is clamped between the clamping rail 5 and the beam 3, see FIG. 13*b*. In a further embodiment, see FIG. 13*c*, the handle 35 is placed sliding on the tube 34 so that in clamping position it may be lowered into a suitable hole 36 in the beam 3. Hereby it is avoided that the handle 35 is actuated by mistake, resulting in loosening the doctor blade 4.

Figure 13A:
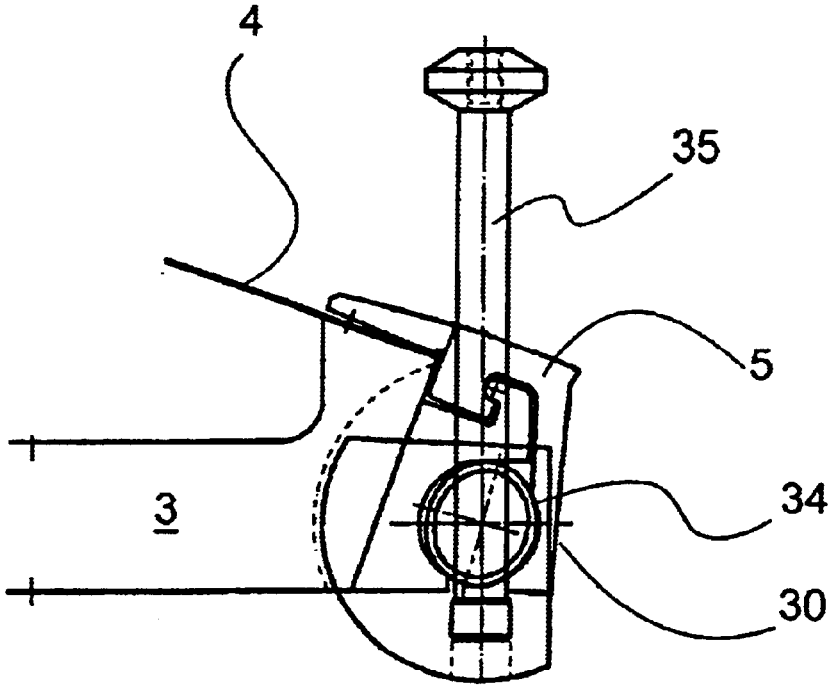
FIG. 13 shows a further embodiment of the invention where the handle on the oval tube is disposed sliding so that it may be lowered into a hole in the doctor beam.
Figure 13B:
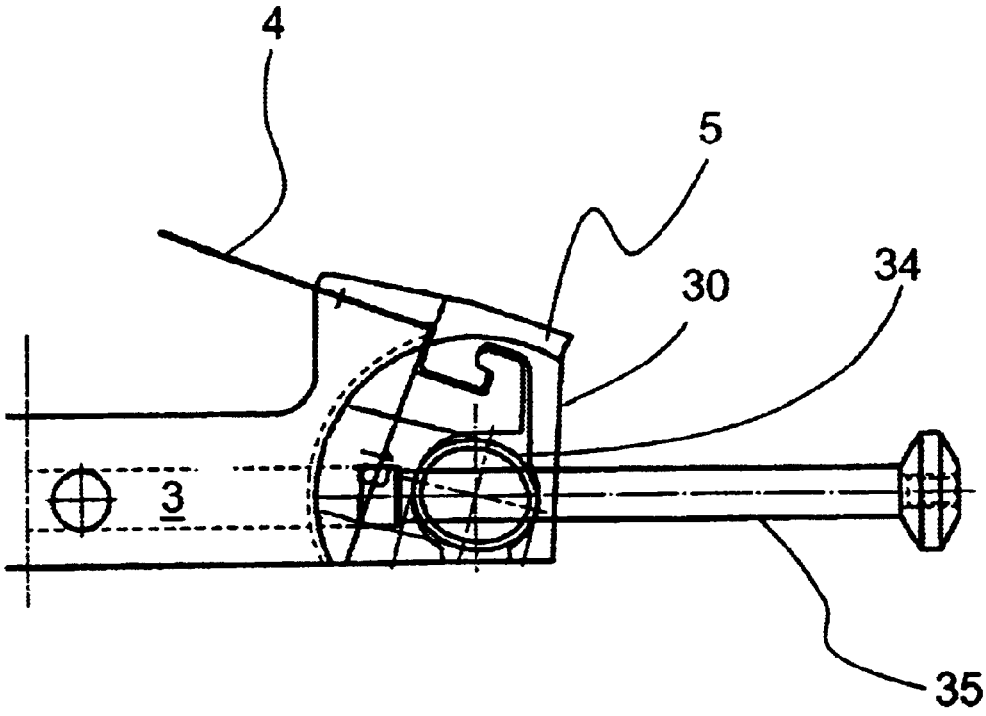
Figure 13C:
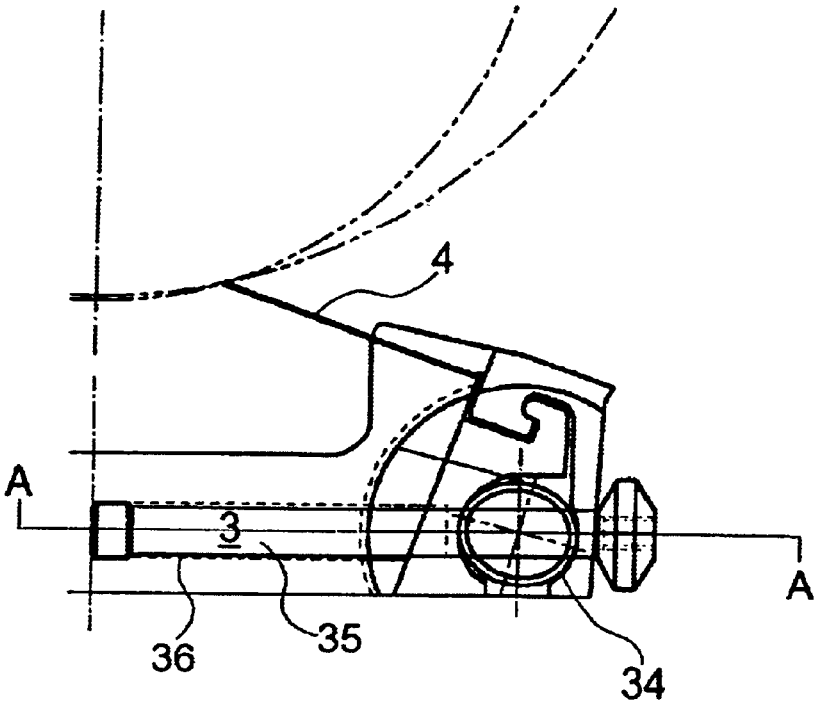
Figure 13D:
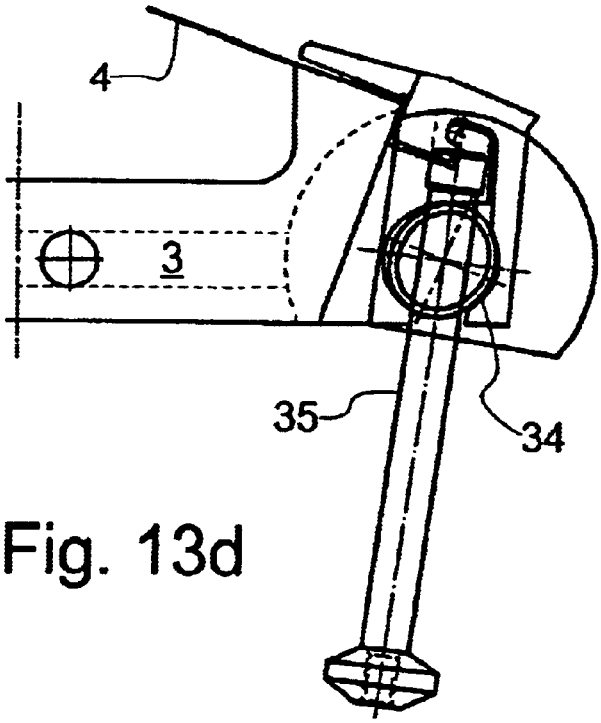

The position of the handle, as shown in FIG. 13*a*, is preferred when the doctor blade 4 is to be loosened from its clamped position. By turning the handle 35 to the opposite position, see FIG. 13*d*, the doctor blade 4 is also loosened but now the tube 34 with handle 35 may also be demounted from the doctor blade chamber by pushing it laterally out of the beam 3.

Figure 13E:
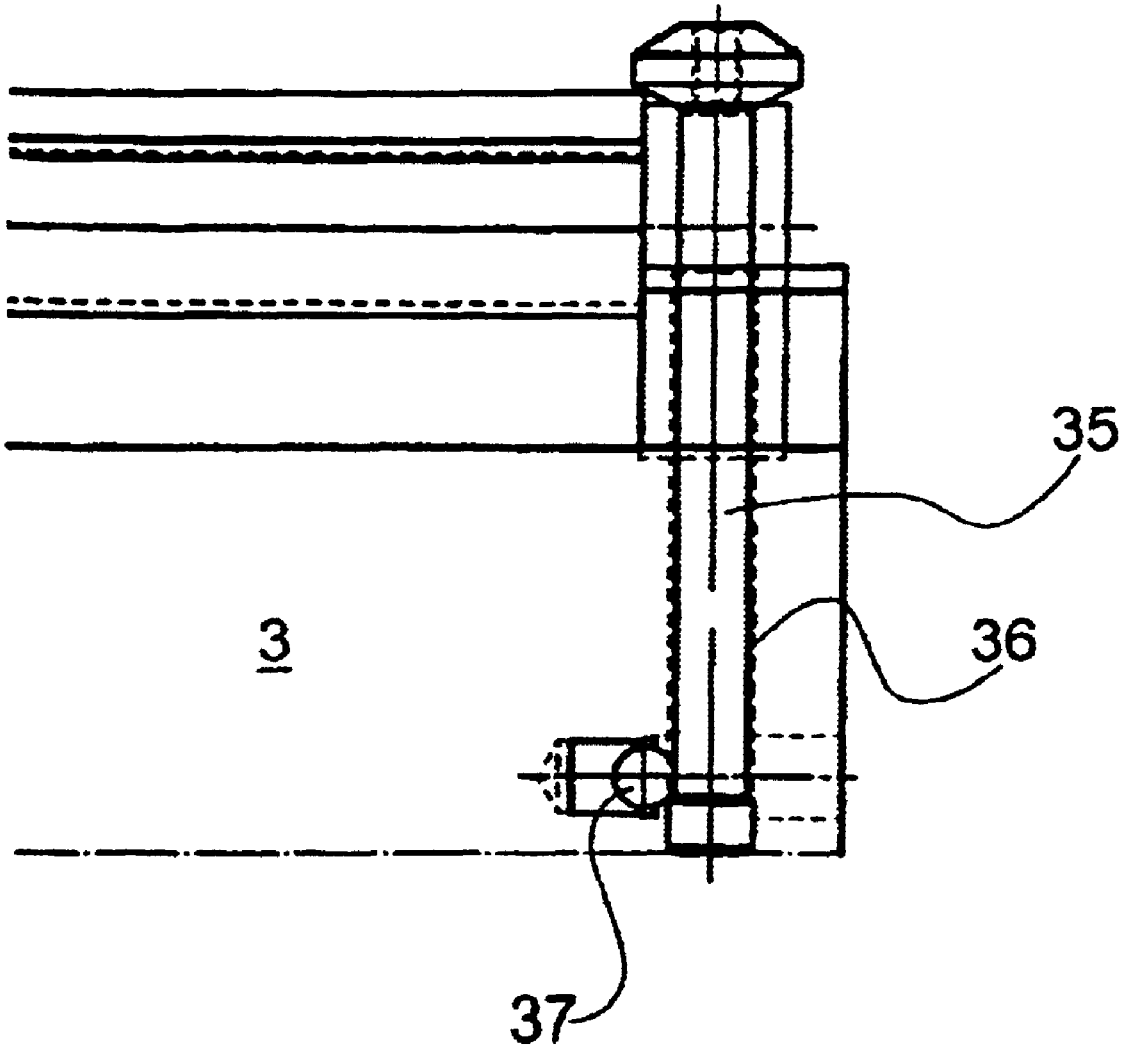

FIG. 13*e* shows in cross-section (A—A in FIG. 13*c*) how the handle 35 is lowered into the beam 3. The hole 36 may be provided with a ball lock 37 in order that the handle 35 does not unsuitably slide out of the beam.

Figure 14A:
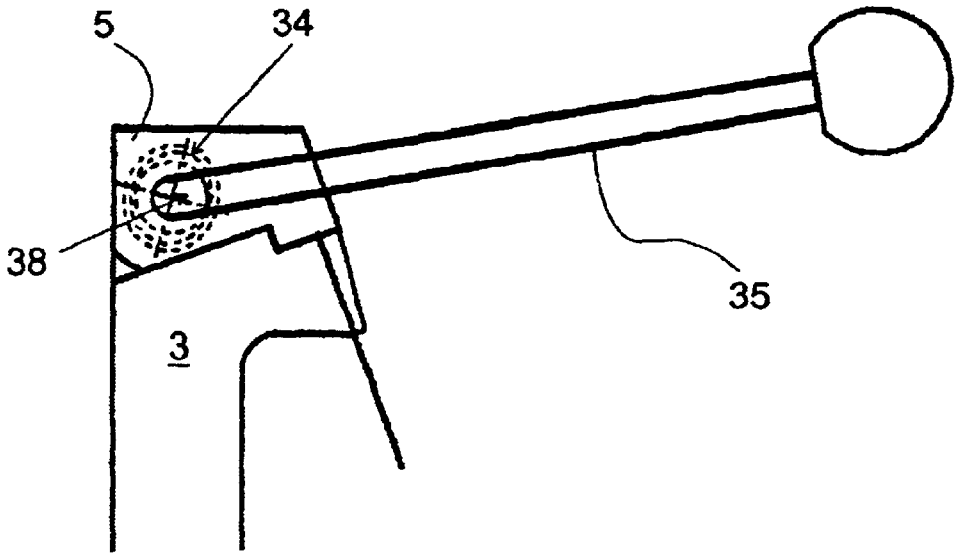
FIG. 14 shows a further embodiment of the invention where the handle on the oval tube is disposed pivotably and sliding so that it may be lowered into the tube itself.
Figure 14B:
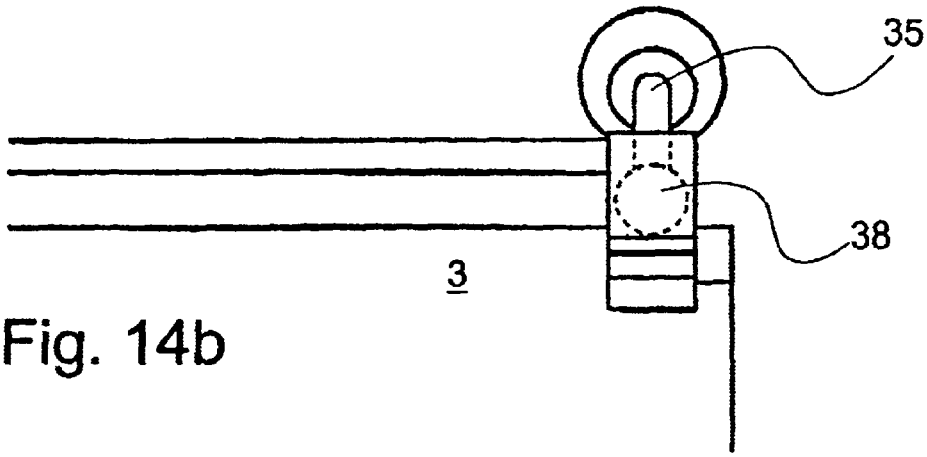
Figure 14C:
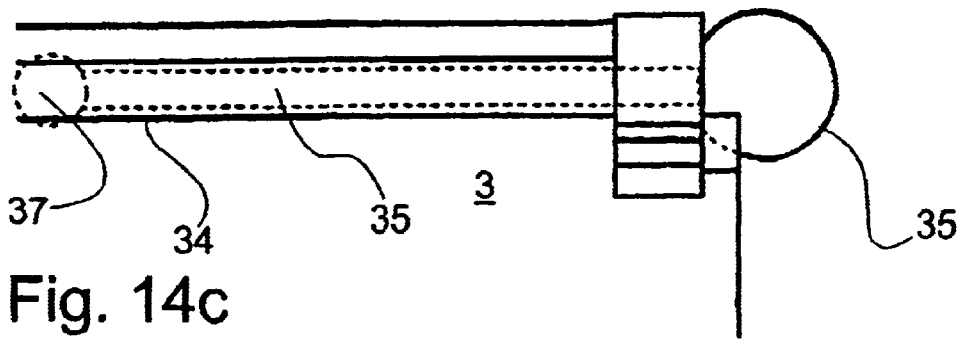

FIG. 14 shows a further embodiment of the invention where the handle 35 on the hollow, oval tube 34 is disposed pivoting and sliding so that it may be lowered into the tube 34 itself. FIG. 14*a* is a draft of the handle 35 when it is pulled out of the tube 34 and in a position for clamping the clamping rail 5 against the doctor beam 3. Between the handle 35 and the tube 34 there is a pivotable articulation 38 designed so that the handle 35 may be pivoted out into a position so that it is in parallel with the tube 34 in order that the handle 35 may be displaced into the tube 34. FIG. 14*b* shows the same situation as 14*a* in another perspective toward the back side of the doctor beam 3. FIG. 14*c* shows the handle 35 lowered into the tube 34. A ball lock 37 prevents that the handle 35 slides out of the tube 34 unintentionally.

1 doctor blade chamber
2 end part
3 doctor beam
4 doctor blade
5 clamping rail
6 screw bolt
7 ink chamber
8 open channel of doctor beam
9 ink transfer roller
10 surface of ink transfer roller
11 part of ink transfer roller inside the ink chamber
12 blocking blade or sealing blade
13 working blade

14 groove in beam of doctor blade chamber
15 groove in clamping rail
16 sectional rail
17 interspace between one side of sectional rail and inner edge of beam groove
18 one side of sectional rail for disposing in beam groove
19 inner edge of beam groove
20 wave spring
21 bottom of beam groove
22 interspace between sectional rail and bottom of beam groove
23 side wall of beam groove
24 fluid tube in interspace between sectional rail and bottom of beam groove
25 inner volume of elastic tube
25*a* tube rotatable about its longitudinal axis
26 resilient polymer tube (rubber tube)
27 resilient section of foam polymer
28 resilient, deformable sectional rail
29 hook
30 first part of clamping rail
31 second part of clamping rail
32 edge of clamping rail
33 tip groove of beam
34 oval tube
35 handle
36 hole in beam
37 ball lock
38 pivotable articulation between handle and tube
39 inner chamber in beam
40 elastic wall of beam chamber
41 outer side of elastic wall
42 sectional bead at outer side of elastic wall
43 groove in doctor beam
44 resilient rail constituting wall in groove of doctor beam
45 groove in beam

What is claimed is:

1. A doctor blade system for printing presses, comprising doctor beam, clamping rail and doctor blade, together with clamping device for fastening the doctor blade between the clamping rail and the doctor beam, where the clamping device forms a mechanical connection between the clamping rail and the doctor beam, which connection is continuous largely over the whole length of the doctor blade, wherein the clamping device also comprises a displacing mechanism which by actuation counteracts the clamping so that the doctor blade thereby is no longer clamped between the clamping rail and the doctor beam.

2. A doctor blade system according to claim 1, wherein the clamping device comprises a rigid sectional rail with a first side engaging a groove in the clamping rail, and with a second side engaging a groove in the doctor beam, together with a device displacing the sectional rail in the groove of the doctor beam inward in direction against the bottom of the groove of the doctor beam.

3. A doctor blade system according to claim 2, wherein the device comprises at least one resilient element disposed between a wall of the beam groove, which opposite to the bottom of the beam groove, and the sectional rail, so that the resilient element by expansion is pressing the sectional rail in direction toward the bottom of the beam groove.

4. A doctor blade system according to claim 1, wherein the clamping device comprises a resilient sectional rail with a first side engaging a groove in the clamping rail, and with a second side engaging a groove in the doctor beam, the resilient contracting force of the sectional rail drawing the clamping rail and the doctor beam towards each other so that the doctor blade is clamped therebetween.

5. A doctor blade system according to claim 2, wherein by actuation, the clamping mechanism comprises an overpressure chamber in the interspace between the bottom of the beam groove and the sectional rail in the beam groove.

6. A doctor blade system according to claim 5, wherein the overpressure chamber comprises a resilient fluid tube expandable by pneumatic or hydraulic means.

7. A doctor blade system according to claim 1, wherein the displacing mechanism comprises a rigid, oval tube being rotatable about its longitudinal axis.

8. A doctor blade system according to claim 1, wherein the clamping device comprises an inner chamber formed in the doctor beam and delimited by a wall facing the clamping rail, and which is resilient with a force directed inward to the chamber, and which at its outward directed side has a sectional bead for engaging a groove in the clamping rail, and that the chamber by actuation of the displacing mechanism comprises an overpressure chamber with outward directed displacement of the wall.

9. A doctor blade system according to claim 1, wherein the clamping rail has an edge longitudinally of the clamping rail engaging a tip groove in the doctor beam so that the clamping rail may tip about this edge, the clamping rail having a first and a second part at each side of the edge, that the clamping device comprises an elongate means disposed between the first part of the clamping rail and a second groove in the beam, the means pressing the first part of the clamping rail and the beam away from each other so that the clamping rail tips about its edge, whereby the second part of the clamping rail is clamped against the beam for fastening the doctor blade.

10. A doctor blade system according to claim 9, wherein the elongate means is constituted by a resilient, oval tube which by maximum ovality effects fixing of the doctor blade, and where the ovality of the tube is reduced by means of pneumatics or hydraulics by actuation of the displacing mechanism whereby the doctor blade is not fixed any more.

11. A doctor blade system according to claim 9, wherein the elongate means is a rigid, oval tube which by rotation about its longitudinal axis increases the distance between the beam and the second part of the clamping rail.

12. A doctor blade system according to claim 2, wherein the groove in the clamping rail is a T-shaped groove.

13. A doctor blade system according to claim 2, wherein the groove in the doctor beam is a T-shaped groove.

14. A doctor blade system according to claim 4, wherein the groove in the clamping rail is a T-shaped groove.

15. A doctor blade system according to claim 4, wherein the groove in the doctor beam is a T-shaped groove.

16. A doctor blade system according to claim 8, wherein the groove in the clamping rail is a T-shaped groove.

17. A doctor blade system according to claim 8, wherein the bead is a T-shaped bead.

18. A clamping device for a doctor blade in a printing press, comprising doctor beam and clamping rail between which the doctor blade is clamped, wherein the clamping device by which the clamping is provided is elongate and form a mechanical connection between the clamping rail and the beam, which connection is continuous largely over the whole length of the doctor blade, and that the clamping device also comprises a displacing device which by actuation counteracts the clamping.

* * * * *